US005348421A

United States Patent [19]

Stegall

[11] Patent Number: 5,348,421

[45] Date of Patent: * Sep. 20, 1994

[54] TRENCH FORMING ASSEMBLY AND METHOD

[75] Inventor: Lannie L. Stegall, Versailles, Ky.

[73] Assignee: ABT, Inc., Troutman, N.C.

[ * ] Notice: The portion of the term of this patent subsequent to Jan. 25, 2011 has been disclaimed.

[21] Appl. No.: 184,911

[22] Filed: Jan. 24, 1994

Related U.S. Application Data

[63] Continuation of Ser. No. 768,610, Sep. 26, 1991, Pat. No. 5,281,051.

[51] Int. Cl.[5] ..... E02B 5/00

[52] U.S. Cl. ..... 405/119; 404/4; 405/118

[58] Field of Search ..... 405/118, 119, 120, 121, 405/124, 125; 404/2-5, 25, 26

[56] References Cited

U.S. PATENT DOCUMENTS

| | | |
|---|---|---|
| 786,305 | 4/1905 | McIntyre . |
| 1,473,551 | 11/1923 | Gschwind . |
| 1,562,780 | 11/1925 | Mickelson . |
| 1,631,825 | 6/1927 | Jones . |
| 1,699,948 | 1/1929 | Biedermann . |
| 1,722,038 | 7/1929 | Dougherty . |
| 2,170,671 | 8/1939 | Adler . |
| 2,657,447 | 11/1953 | Pellanda, Jr. . |
| 2,677,165 | 5/1954 | Copenhaver et al. . |
| 2,917,804 | 12/1959 | Barron . |
| 2,938,437 | 5/1960 | Daley . |
| 3,212,267 | 10/1965 | Biehn . |
| 3,299,785 | 1/1967 | James . |
| 3,362,167 | 1/1968 | Ward . |
| 3,568,455 | 3/1971 | McLaughlin et al. . |
| 3,625,011 | 12/1971 | Stevenson . |
| 3,797,188 | 3/1974 | Mansfeld . |
| 4,142,371 | 3/1979 | Mayfield et al. . |
| 4,258,897 | 3/1981 | Stees . |
| 4,472,078 | 9/1984 | Karbstein . |
| 4,498,807 | 2/1985 | Kirkpatrick et al. . |
| 4,787,773 | 11/1988 | Kehler . |
| 4,844,655 | 7/1989 | Aleshire . |
| 4,878,782 | 11/1989 | Beattie et al. . |
| 4,957,268 | 9/1990 | Picollo et al. . |
| 4,993,877 | 2/1991 | Beamer . |
| 4,993,878 | 2/1991 | Beamer . |
| 5,000,621 | 3/1991 | Beamer . |
| 5,061,116 | 10/1991 | Monks . |
| 5,066,165 | 11/1991 | Wofford et al. . |

FOREIGN PATENT DOCUMENTS

| | | |
|---|---|---|
| 968267 | 10/1982 | U.S.S.R. . |

*Primary Examiner*—Dennis L. Taylor

*Attorney, Agent, or Firm*—Bell, Seltzer, Park & Gibson

[57] ABSTRACT

An assembly (10) for forming a trench (T) includes one or more frame members (16) that cooperate with a removable form (12) around which a moldable trench forming composition (C) is poured. The form is made of deformable buoyant material such as expanded polystyrene. Rebar legs (18) are attached to the frame members to provide secure anchoring of the frame members to both the ground (E) and in the trench forming composition. Preferably, each frame member includes a horizontal leg that is received in a slot (22) formed in one of the opposing side walls of the form. The cooperating engagement between the frame member (16) and the form provides longitudinal support to prevent the buoyant form (12) from lifting within the trench composition (C) while also maintaining the proper spacing and planar alignment of the frame members. Wire strands (28) are placed within cooperating guide tracks (24) in the opposed ends of the form. The wire strands are pulled through to deform the form after the composition has hardened. To form the trench, a ditch (D) is prepared. The trench form assembly is prepared and then secured in the ditch. The moldable trench forming composition is poured around the form assembly and allowed to set. The form is then deformed by pulling the deforming wire strands through the form. The segmented form is then removed to reveal the finished trench.

22 Claims, 3 Drawing Sheets

TRENCH FORMING ASSEMBLY AND METHOD

This application is a continuation of U.S. patent application Ser. No. 07/768,610, filed Sep. 26, 1991, now U.S. Pat. No. 5,281,051.

TECHNICAL FIELD

The present invention relates generally to the construction field, and more particularly, to a method and assembly for forming a trench with a moldable trench forming composition such as concrete.

BACKGROUND OF THE INVENTION

There are many applications for subterranean structures such as trenches. Many manufacturing facilities use water throughout the plant for a variety of functions and thus require drainage systems to collect, remove and/or recycle the water. For outdoor applications, many industrial and commercial sites require drainage trenches and catch basins in order to direct rainwater to underground storm sewers and prevent flooding.

Trenches for such purposes are generally formed by pouring a moldable trench forming composition such as concrete around a form that has been placed in a ditch dug in the ground. The concrete is poured around the form and allowed to set. After the concrete has set, the form is removed so that the trench may be readied for use.

The most common form assembly used in the creation of a trench includes wood sheeting or planks and a supporting frame/strut structure that are secured within the ditch. The concrete is then poured between the ground wall and the sheeting/planks. The sheeting/planks and surrounding ground support the concrete while it sets to form the trench. The sheeting/planks and supporting frame are broken down and removed from the trench following the setting of the concrete. Since the sheeting/planks for this application are not prepared with great attention to surface character, it is likely that the wood texture and thus the trench surface is relatively rough and grainy, reducing the flow efficiency of the completed trench.

It can be appreciated that in circumstances where a long trench is required, a great deal of sheeting or many planks need to be secured together end to end in order to construct the form for the trench. Labor costs to complete the form are often excessive. This is particularly true since intricate rib work is often required to support the sheeting/planks in position against the relatively high pressures exerted by the heavy concrete. Additionally, there is often a precise pitch that is required from one end of the trench to the opposite end to provide proper drainage. The skill and care that is required in cutting and constructing the wood sheeting/planks to produce a form of desired shape and needed pitch significantly increases the labor time required and thus the overall construction cost for the trench.

Further, a grate is often supported over the trench by means of a pair of spaced frames that are set in the concrete. Unless these frames are maintained in proper alignment in a common plane during the pouring and setting of the concrete, the grate held in the frames will be unstable and prone to rocking when weight from, for example, a vehicle is applied. This condition may lead directly to damage to the grate and/or the frames and possibly even the surrounding concrete. In extreme cases, the grate may even become dislodged from the frames leaving the top of the trench open. Possible serious injury may result from such a safety hazard. Accordingly, it should be appreciated that extreme care must be exercised when constructing the form and positioning the frames relative to the form. The time necessary to exercise this care also adds significantly to the labor costs. In addition, a great deal of time is required to dismantle and remove the form following the setting of the concrete.

In some situations, precast trenches are used to avoid some of these difficulties. In general these assemblies are preformed metal assemblies that are placed in a ditch and are intended to permanently remain after concrete is poured around it for stabilization and support. However, such precast assemblies are expensive, especially in situations where the application requires unique customization.

A need is thus identified for an easier and quicker method of forming trenches, particularly, for industrial and commercial applications. The present invention is designed to fulfill these needs. The present trench forming assembly is inexpensive to fabricate and use and substantially reduces the time required to complete the trench for operative use. The invention is very versatile, adapted to be customized and adjusted to meet on-site specifications. The use of the invention provides a completed trench that efficiently blends into the operative environment.

SUMMARY OF THE INVENTION

Accordingly, it is a primary object of the present invention to provide a trench forming assembly and method that overcomes the above-described limitations and disadvantages of the prior art.

It is another object of the present invention to provide a trench forming assembly and method that are relatively simple and convenient to use requiring only a relatively low skill level to accurately form a trench.

Yet another object of the present invention is to provide a relatively versatile trench forming assembly and method particularly adapted to accommodate almost any profile trench design and almost any grating or rail design. Advantageously, customized forming may be efficiently completed in a relatively short period of time so as to substantially reduce labor costs.

A further object of the present invention is to provide a trench forming assembly and method wherein the form may be quickly and easily broken down and removed following the setting of the concrete poured around the form.

Yet another object of the present invention is to provide a trench forming assembly that is relatively light in weight and may be assembled in a shelter and then conveniently transported to a construction site.

Yet another object of the present invention is to provide a trench forming assembly wherein a form of lightweight expanded polystyrene is provided. The form may be easily and conveniently shaped and cut to provide the desired drainage pitch. The lightweight form also advantageously is adapted to capture the grate supporting rails of the frame that are secured in the ground of the ditch or a pre-pour subslab by rebar legs during assembly. The frame rails advantageously hold the form against movement, particularly due to buoyant forces exerted by the fluid concrete as it is poured into the ditch.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and the combinations particularly pointed out in the appended claims.

To achieve the foregoing and other objects, and in accordance with the purposes of the present invention as described herein, an improved trench forming assembly and method are provided. The assembly for forming a trench in the ground includes a frame, preferably formed of metal, for supporting a trench cover such as a grate or plate. Means are also provided for anchoring the frame in the ground. Any known structure may be utilized for this purpose including rebar legs welded to the frame that are secured by a pre-pour subslab or are staked in the ground. Additionally, the assembly includes a removable trench form that is adapted for shaping a moldable trench forming composition such as concrete poured around the form. The form also includes integral slot means for engaging and capturing the frame whereby the form and frame are securely held substantially against movement as the concrete sets to form the completed trench. The assembly is also contemplated for use in forming the catch basin into which the trench discharges. Further, the assembly may also be adapted to form a catch basin simply as a discrete structure.

Preferably, the removable form is made from a material that may be readily shaped by molding and/or cutting to provide the desired shape of trench with the desired pitch for best drainage. The form may even be shaped to provide a round bottom trench, thereby eliminating corners that allow the collection of sediment and providing for better self-cleaning action. It is also preferred that the form be made of a lightweight material so that the trench assembly may be constructed in a shelter if desired and then transported to the job site. Most preferably, the form is constructed from expanded polystyrene.

In accordance with yet another aspect of the present invention the assembly includes a means for deforming the form in a convenient and efficient manner for removal from within the concrete once the concrete has set. More particularly, the assembly includes at least one wire strand and preferably two that extend longitudinally within the bottom wall of the form for substantially its full length. The opposing ends of each wire strand are received in and extend through a pair of cooperating, substantially vertically extending guide tracks formed along the bottom of the form. The ends of each wire strand may be wrapped around a handle as, for example, an elongated rod or bar (e.g. a short piece of rebar). After the concrete is set, the wire strands may be pulled through the form by manipulation of the handle, thereby cutting the form and allowing easy removal from the concrete trench.

In accordance with the present method of trench forming, is the step of preparing a ditch for the trench. More particularly, an appropriate ditch is dug in the ground by hand with a mattock and shovel or, for example, with heavy machinery such as a backhoe. Next is the step of anchoring a trench form assembly in the proper position in the ditch. As described above, the trench form assembly includes a frame and a removable form having integral slots for engaging the frame and securely holding the two together in relative position. Additionally, the method includes a step of pouring a moldable trench forming composition such as concrete in the ditch around the form assembly. Once the concrete sets around the form assembly, the trench is formed.

The method also includes a step of removing the form following the setting of the trench forming composition. This is accomplished by pulling one or more wire strands through the form so as to deform the form for removal. This is followed by withdrawing the deformed form from the completed trench.

In accordance with yet another aspect of the present invention, the trench form assembly is prepared by initially cutting the form to an appropriate trench forming configuration. Additionally, slots are cut in opposing sidewalls of the form for engaging the frame. The assembly is then constructed by engaging the frame in the slots. Vertically extending guide tracks are also cut along the entire length of the bottom wall of the form to receive the deforming wire.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification illustrates several aspects of the present invention and together with the description serves to explain the principles of the invention. In the drawing.

FIGS. *2a–2e* are schematic perspective and side elevational views detailing the steps of the present method of forming a trench.

Reference will now be made in detail to the present preferred embodiment of the invention an example of which is illustrated in the accompanying drawing.

DETAILED DESCRIPTION OF THE INVENTION

Figure 1:
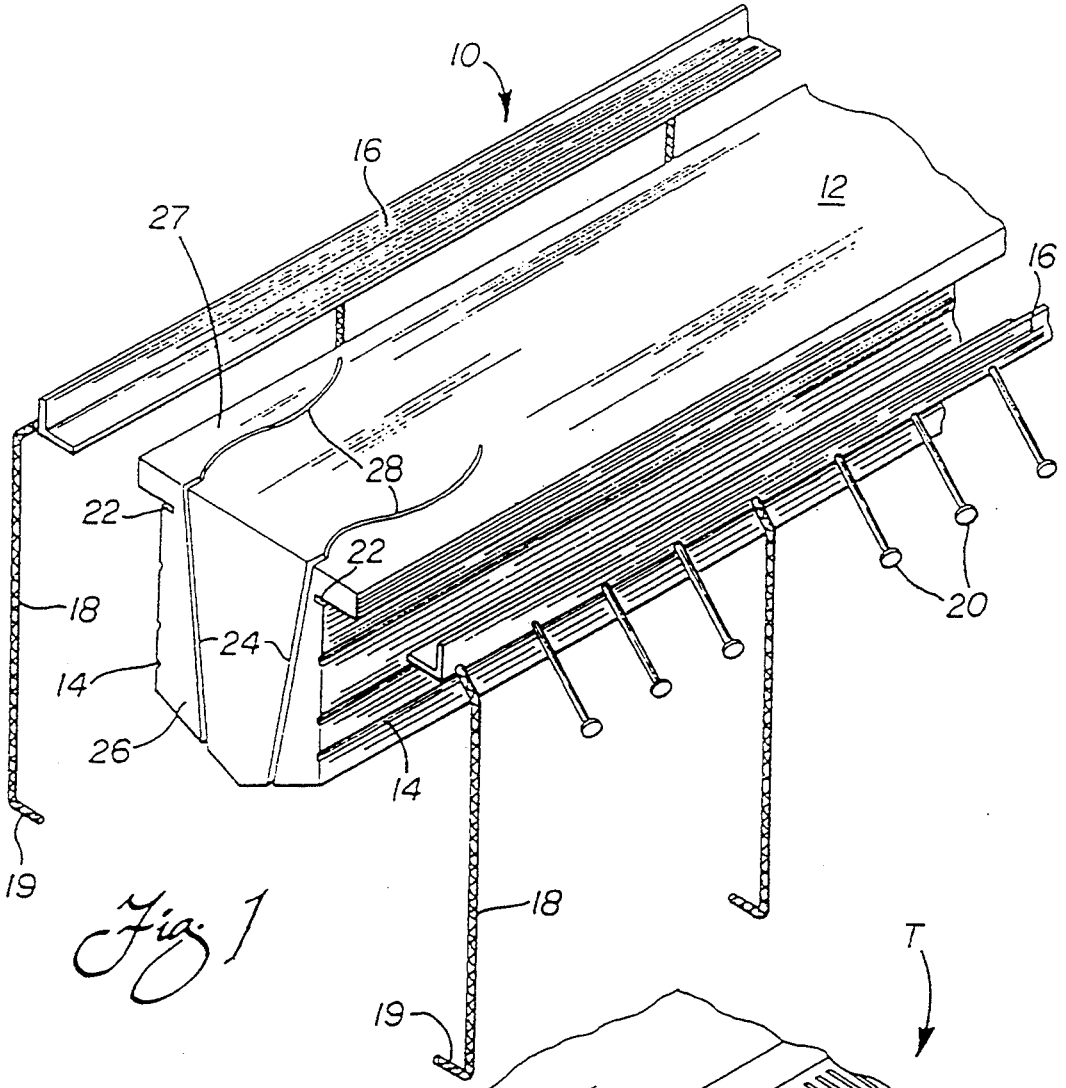
FIG. 1 is a partially exploded view of the trench forming assembly of the present invention.

Reference is now made to the drawing figures and particularly FIG. 1 showing the trench forming assembly 10 of the present invention. As shown, the trench forming assembly 10 includes a trench form 12, preferably made of expanded polystyrene. Advantageously, the trench form 12 may be molded and then cut and/or shaved to any desired shape to provide a form that may be readily customized for any application. This includes the ability to provide a trench with a rounded bottom and/or of any desired pitch to maintain the necessary drainage flow in the trench that is to be formed. As shown the polystyrene form 12 may include indentations 14 along its sides that aid an individual during the cutting/shaving operation to help insure that the form is properly prepared to meet job specifications. The indentations 14 also provide additional surface area to assist in the trench forming process when there is segmented or stepped concrete pouring.

Figure 2E:
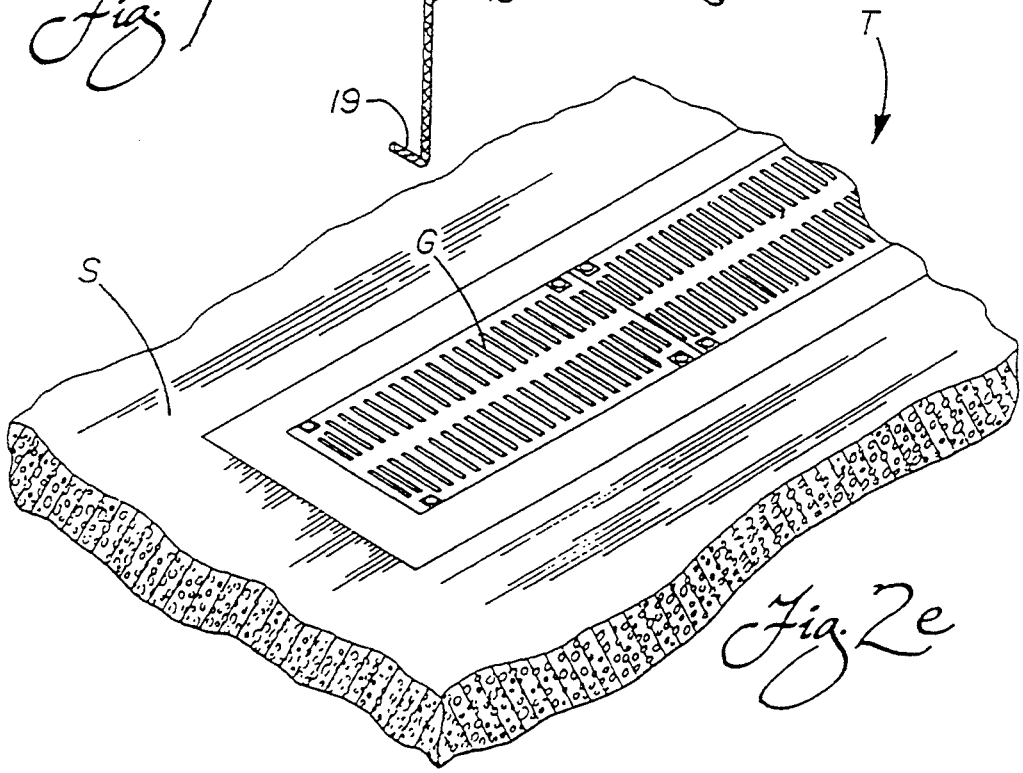

As will be appreciated as the description proceeds, the trench being formed is adapted to be covered by a grating shown by reference letter G in FIG. 2*e*. As is known in the art, the grating G is held in position by means of a support frame 16 shown as a pair of opposed cooperating members or rails in FIG. 1. Each frame member 16 may, for example, comprise a substantially L-shaped angle iron. The substantially vertically extending leg of the frame member 16 is adapted to engage the sides of the grating G and prevent the grating from shifting laterally across the opening to the trench T. Similarly, the substantially horizontally extending leg of the frame member 16 is adapted to support the gratings G over the trench T by engaging the bottom face of the grating. The horizontally extending legs of both frame members 16 also advantageously cooperate with the trench form 12 during the forming process as will be described in more detail below.

A series of reinforcing steel rods 18, also known as rebar legs, are welded to the rear of each frame member 16. The rebar legs 18 are angled and bent so as to extend downwardly for engagement with the ground at the bottom of a ditch D in a manner described in greater detail below (see FIG. 2*b*). Advantageously, the rebar legs 18 serve to allow the frame members 16 to be firmly anchored and held in position during the pouring and setting of the concrete. Preferably, each rebar leg 18 includes a foot 19. The feet 19 allow the trench forming assembly 10 to rest on the ground of the ditch D as is shown in FIG. 2*b*. During the trench forming procedure, the feet 19 are anchored against movement in a pre-pour subslab P (see FIGS. 2*b* and 2*c*) prior to the pouring of concrete C to form the trench.

Alternatively, the rebar legs 18 may be formed without feet 19. In this alternative embodiment, the rebar legs 18 are staked and driven into the ground of the ditch D.

A series of stabilizing studs 20 may also be welded to and extend from the rear side of each frame member 16. These studs serve to further anchor the frame members 16 in position in the concrete.

Figure 2A:
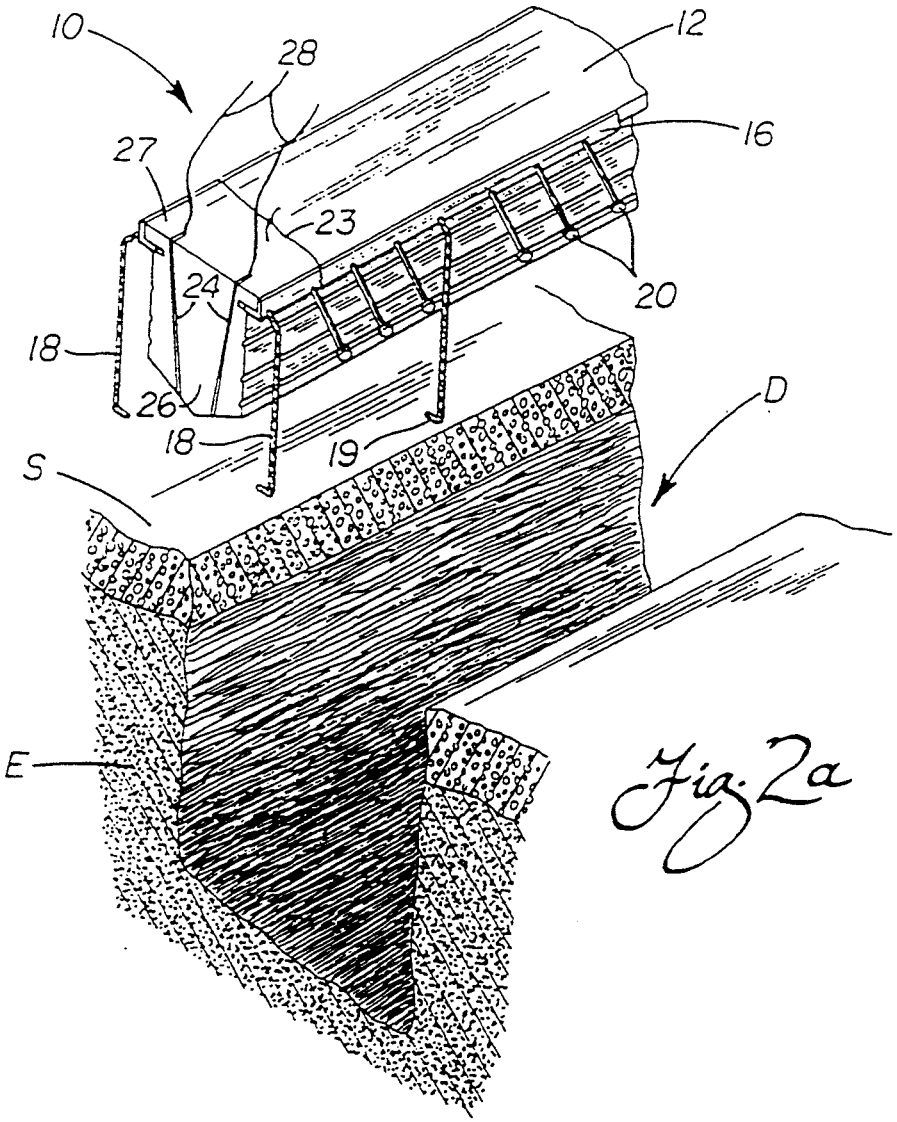
Figure 2B:
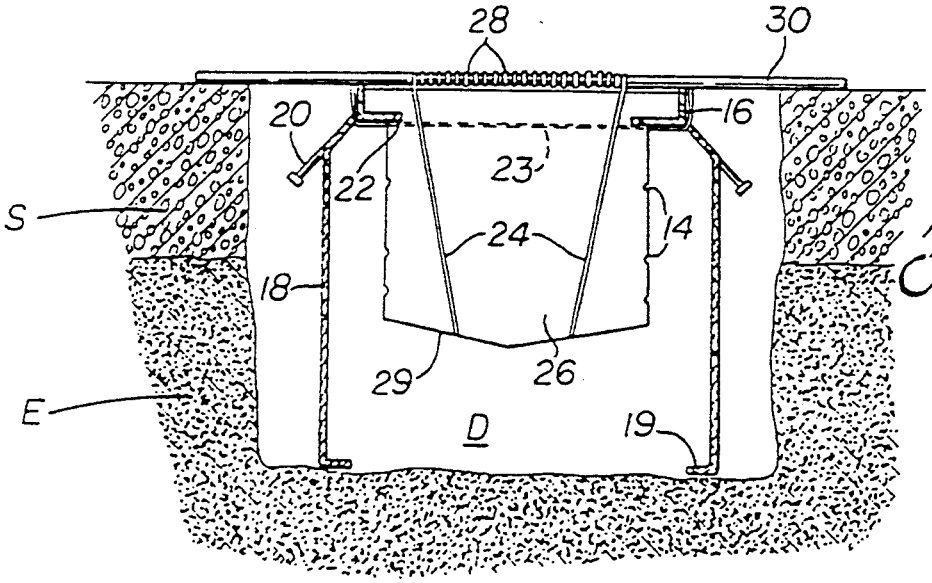
Figure 2C:
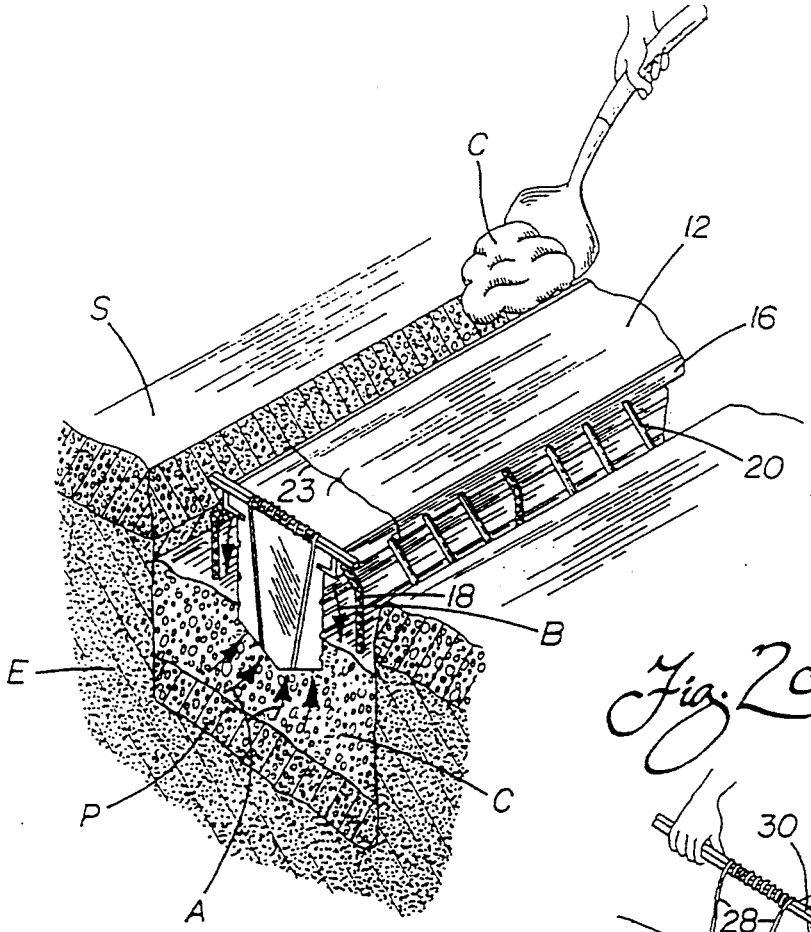
Figure 2D:
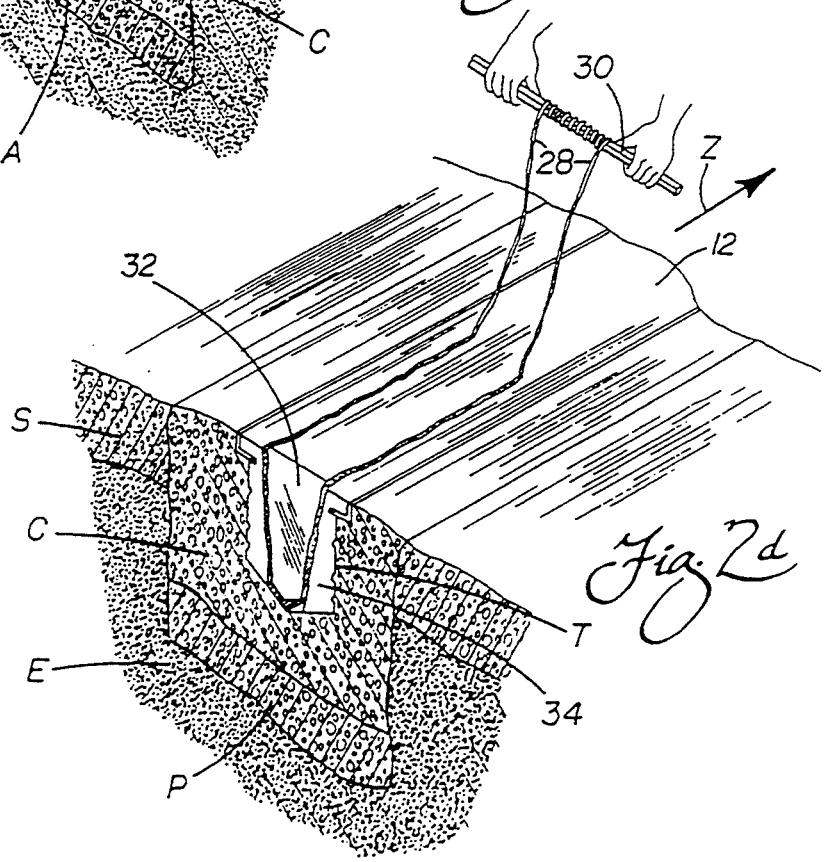

As best shown in FIGS. 1, 2*a* and 2*b*, the form 12 may be substantially T-shaped in cross section. A pair of longitudinally extending slots 22 may be formed or cut in the form 12 at the intersection where the substantially vertical and substantially horizontal legs of the T-shaped form meet. Each slot 22 is adapted to engage the horizontally extending leg of one of the frame members 16. A plurality of longitudinally spaced tie wires 23 (i.e. using 16 guage wire) inserted through cooperating transverse holes punched in the form 12 may be used to secure the form and frame members 16 together. Advantageously, this results in the frame members 16 being securely held in position with proper spacing and in proper planar alignment so as to securely support the grating G in position over the trench T once the trench is completed. By insuring both proper spacing and planar alignment, the assembly 10 effectively eliminates the grate rocking problem prevalent in trench installations constructed with the prior art form designs. It also does this while eliminating the tedious and time consuming adjustment steps necessary to insure proper alignment in prior art wood forming methods.

In addition to the spacing and alignment function provided by the cooperating engagement between the form 12 and the frame members 16, the frame members also hold the form substantially against movement during the trench forming procedure. More particularly, since the form 12 is preferably formed of lightweight expanded polystyrene, it is urged upwardly by the buoyant forces of the fluid concrete C as the latter is poured into the ditch D (see action arrows A in FIG. 2*c*). Remembering that the frame members 16 are spatially fixed due to firm anchoring of the rebar legs 18 in the pre-pour subslab P or the ground, the engagement between the horizontally extending legs of the frame members in the slots 22 of the form 12 prevents the latter from shifting upwardly as the concrete is poured. It is particularly important to note that since the frame members 16 engage the form 12 on opposing sides and along substantially its entire length, the forces exerted by the horizontally extending legs (see action arrow B in FIG. 2*c*) to counterbalance the buoyant forces are spread evenly and longitudinally along the form. This minimizes the chance of internal deformation of the form 12.

It should also be appreciated that the form assembly 10 may be constructed to specification at a remote, sheltered site where all the necessary tools and equipment are conveniently available. More specifically, after determining the required slope an appropriate chalk line is placed on each sidewall of the raw polystyrene form material. A hand saw may then be used to trim the raw form material to the chalk line.

Alternatively, the pitch may be incorporated into the form 12 through the angle to which the frame engaging slots 22 are cut. More particularly, instead of a T-shaped form 12, the form may be fabricated with substantially straight walls from top surface to bottom surface along both sides. The slots 22 are then be cut to appropriate pitch. The frame members 16 then engage the form 12 and the bottom surface of the form is automatically positioned at the appropriate pitch when the frame members 16 are anchored in the pre-pour subslab P or the ground of the ditch D at the appropriate level plane. In the alternative embodiment, a series of tangs may be tack welded on the upper surfaces of the horizontally extending legs of each frame member 16, the tangs spaced inwardly from the vertically extending legs. The polystyrene form 12 engages and extends between these tangs and thus the desired lateral spacing of the frame members 16 is maintained. Once the concrete sets and the form is completed, the tangs are removed from the frame members 16 and the grate G positioned as shown in FIG. 2*e*.

After the form 12 has been cut to the proper overall shape including length, width and depth and shaved or cut to provide the desired drain pitch, the side and bottom walls of the form are treated with a release compound of the type known in the art to prevent the form from sticking to the concrete. Next, the frame members 16 may be positioned in the slots 22. As indicated above, the slots 22 are cut so as to positively engage and securely hold the frame members 16 in position with the assistance of the tie wires 23. The assembly 10 may then be transported to the job site and positioned in place in a ditch D dug for the trench as a one piece unit in the manner described below.

In accordance with yet another aspect of the present invention, the form 12 is cut so as to include one or more guide tracks 24 extending into each end wall 26 and through the top and bottom surfaces 27, 29 of the form respectively. Slightly away from the end walls 26, the guide tracks 24 are cut from the bottom surface 29 to a position part way toward the top surface 27. At least one and preferably two wire strands 28 are received in the guide tracks 24. Each wire strand 28 extends along the entire length of the form 12 and is exposed through the guide tracks 24 at each end 26 of the form 12. Additionally, as best shown in FIGS. *2b*, *2c*, and *2d*, each end of each wire strand 28 (e.g. again using 16 gauge tie wire) may be wrapped around a rod or bar 30. The rod or bar 30 effectively serves as a handle which allows the wire strands 28 to be pulled through the form 12 when it is necessary to remove the form from the set concrete. Alternatively, the distal end of each wire strand 28 may remain free and be pulled by hand in accordance with the deforming procedure described in greater detail below. It can be appreciated that when tie wires 23 are used in the assembly 10, they are removed prior to the deforming operation.

Turning to FIGS. *2a–2e*, the method of the present invention will now be described in detail. A ditch D is dug in the ground E at the job site utilizing hand tools such as picks and shovels or heavy machinery such as a back hoe in a manner known in the art to correspond to the individual job specification. The trench forming assembly 10 of the present invention as described above may be assembled either before or after the ditch D is dug. Additionally, the appropriate asphalt pavement or concrete skirt S may be prepared up to the edge of the ditch to establish the final exposed surface as shown in the drawing. Of course, the skirt S may also be formed as part of the same concrete pour used to form the trench T.

After the ditch D is prepared, the trench forming assembly 10 is positioned in the ditch. As shown in FIG. *2b*, the rebar legs 18 extending from the frame member 16 are anchored by pouring a prepour subslab P that is allowed to set around the feet 19 of the rebar legs. Alternatively, as described above, rebar legs 18 without feet 19 may be driven into the ground E at the bottom of the ditch D so as to hold the frame members 16 and trench form 12 in the proper position in the ditch.

When positioning the trench forming assembly 10 in the ditch D, it is important to insure that the top edge of the frame members 16 are maintained at the proper height: that is, for example, level with the surrounding skirt S. This may be done utilizing a level or other straightedge which may be extended across the ditch D while resting on the skirt S. Thus, the trench forming assembly 10 and more particularly, the rebar legs 18 are properly positioned so that the straightedge engages the skirt S on both sides of the ditch D as well as the upper edges of the frame members 16. At that point the trench forming assembly 10 is in proper position within the ditch as shown in FIG. *2b*.

The leveling procedure may also utilize posts commonly referred to as batter boards extending between leveling reference points that are a significant distance apart. This is particularly appropriate when the skirt S to be adjacent the trench T is formed as part of a singular concrete pour. The boards are generally secured in place across the top of the assembly 10 with the use of wire that is tied to the rebar legs 18 or the studs 20. It can be appreciated that, when used and left in place during the pouring of concrete, the batter boards provide additional protection against buoyant forces of the fluid concrete C that tends to lift the form 12.

Where more than one trench forming assembly 10 is utilized, the individual trench forming assemblies may be connected together where the sections join by any appropriate means such as a tie wire or lap joint. The vertical sides of the intersecting frames 16 should also be plumb before the concrete is poured. Additionally, the drain pipe leading from the trench T being poured should be plugged to prevent it from filling with concrete. This may be done in a number of ways including taping over the opening of the pipe and/or pressing the polystyrene form 12 into the pipe so that the opening is effectively sealed.

After the trench forming assembly 10 is secured in place in the ditch D, the method continues with the pouring of a moldable trench forming composition such as concrete C into the ditch around the form assembly. Preferably, the concrete C is poured substantially equally on both sides of the form assembly 10 so as to help insure alignment. As is known in the art, such a procedure is important as forces produced by the weight of poured concrete C are significant. Accordingly, the form assembly 10 may shift when caution is not observed. Vibration of the concrete C may also be necessary to insure that the bottom of the trench T is formed completely. The step of pouring concrete C is shown in FIG. *2c*.

After the concrete C sets, it is necessary to remove the form 12. This may be conveniently and efficiently accomplished utilizing the form assembly 10 of the present invention. More particularly, as indicated above and shown in the drawing figures, a pair of wire strands 28 extend longitudinally along substantially the entire length of each form 12. Each wire strand 28 is received in one of a pair of cooperating guide tracks 24, extending between each end 26 of the form 12. The ends of each wire strand 28 are wound onto a handle 30 such as a rod or bar. The form is removed by pulling the wire strands 28 through the form 12 by manipulation of one or both of the handles 30. Of course, when tie wires 23 are used, they are removed prior to the deforming process.

More particularly, as shown in FIG. *2d*, one handle 30 may be grasped and pulled in the direction of action arrow Z. As this is done the wire strands 28 are pulled upwardly through the form 12. This action is possible since the opposite ends of the wire strands 28 are anchored to another handle 30 that engages the form 12 thereby preventing the wire strands from simply slipping out from under the form without completing the desired cutting action. Advantageously, by positioning the guide tracks 24 at an angle between substantially 5° and 25° degrees removed from vertical as best shown in FIG. *2b*, the pulling forces actually serve to draw the center section 32 being cut from the form 12 upwardly. Substantially simultaneously, forces are applied to the outer sections 34 which tend to draw them inwardly so that they converge and pull away from the concrete sidewall of the trench T. This significantly aids in the removal of the form 12 from the trench T.

After the wire strands 28 are completely pulled through the form 12, the center wedge section 32 is removed from between the frame members 16. Of course, to aid in gripping the center wedge section 32, any substantially pointed instrument such as a pick, screwdriver or pinch bar may be pushed into the form material. The tool or implement may then be manipulated to aid in withdrawing the wedge section 32. After the wedge section 32 is withdrawn, the outer sections are also removed from the trench in a similar manner. Preferably, the release material previously applied to the sides of form 12 substantially prevents the material of the form from sticking to the sidewall of the completed trench T. After the form 12 has been removed from the trench T, the plug is removed from the drainpipe and the grating G is placed in position between the frame members 16 (see FIG. 2*e*). Accordingly, the trench T is completed.

In summary, numerous benefits have been described which result from employing the concepts of the present invention. Advantageously, the present assembly 10 and method simplify the trench forming procedure so as to allow the accurate formation of customized trenches while requiring a relatively low skill level to complete the task. This simple and efficient trench forming method substantially reduces labor time and, accordingly, labor costs. The assembly 10 may also be quickly and conveniently deformed by pulling the wire strands 28 through the form 12 so as to allow easy removal in a reduced period of time. It should also be appreciated that the completed trench T may be filled with water prior to removing the drain pipe plug. Expanded polystyrene form debris floats in the water to the top of the trench T for easy removal.

Advantageously, it should also be appreciated that the form assembly 10 is relatively light weight and may in fact be assembled at a remote shelter and transported to the job site for utilization. Further, it must be noted that the form 12 incorporates integral slots 22 that serve to capture the frame member or rails 16 that hold the grating or trench cover G. Accordingly, the frame members 16 are held in proper planar alignment and in the proper spacing to insure the grates G will be held in the proper position once the trench T is completed. Thus, the problem of rocking grates and the associated difficulties and safety hazards resulting from the rocking problem are also substantially avoided. Additionally, the cooperating engagement between the frame members 16 and the slots 22 of the form 12 prevents the form from floating in the fluid concrete as it is poured.

It should also be appreciated that the form 12 may be left in place to prevent debris from entering the trench T and piping as nearby. construction is completed. The form 12 also has sufficient strength to support vehicles when utilized in this manner after the concrete trench has set. The form 12 further provides smoother walls for the completed trench T than with wood sheeting/-plank forms, increasing the flow efficiency through the trench.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the form assembly 10 may be adapted to construct a catch basin either as a discrete structure or adjacent the trench T formed by the practice of the invention. It can be visualized that the form 12 may easily be shaped to provide the appropriate dimensions, including depth, for the catch basin. The embodiment disclosed herein was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An assembly for forming a trench of predetermined shape comprising:

a pair of elongate members defining a support surface for supporting a trench cover, each of said members comprising an elongate horizontal leg;

anchoring means attached to each of said elongate members for anchoring said elongate members in a predetermined location;

a removable form body for shaping a moldable trench forming composition poured around said form body comprising a lightweight, buoyant body having opposed side surfaces and a bottom surface defining said predetermined shape of said trench, said form body including coplanar, substantially horizontal, upwardly facing surfaces formed along upper portions of said opposed side surfaces and extending substantially the entire length thereof, said coplanar, substantially horizontal surfaces of said form body being engaged against bottom surfaces of the elongate horizontal legs of said elongate members substantially along the entire length of said form body;

whereby said elongate horizontal legs of said elongate members cooperate with said form body to counterbalance buoyant forces resulting from moldable trench forming composition poured around said form body during forming of said trench and thereby prevent said form body from shifting upwardly as said trench forming composition sets to form a completed trench.

2. The assembly of claim 1 wherein said elongate members comprise a pair of opposed substantially L-shaped frame members.

3. The assembly of claim 1 wherein said anchoring means extend below said form body.

4. The assembly of claim 3 wherein said anchoring means comprise foot means at a lower portion thereof.

5. The assembly of claim 1 wherein said removable form comprises a predetermined shape of predetermined dimensions including depth defining a catch basin.

6. The assembly of claim 1 wherein said horizontal legs of said elongate members comprise rails for supporting a trench grate.

7. The assembly of claim 1 wherein said removable form body is a foamed plastic body.

8. The assembly of claim 3 wherein said removable form comprises a predetermined shape of predetermined dimensions including depth defining a catch basin.

9. The assembly of claim 3 wherein said horizontal legs of said elongate members comprise rails for supporting a trench grate.

10. The assembly of claim 1 wherein said removable form body is a one piece body.

11. A method of forming a trench of predetermined shape, comprising the steps of:

providing a ditch for said trench;

providing a form assembly comprising a pair of frame members each comprising an elongate horizontal leg, anchoring members attached to each of said frame members, and a removable form body comprising a solid, buoyant body including a bottom surface and opposed side surfaces defining said predetermined shape of said trench, said form body including coplanar, substantially horizontal, upwardly facing surfaces formed along upper portions of said opposed side surfaces and extending substantially the entire length thereof, said horizontal surfaces of said form body being engaged against bottom surfaces of the elongate horizontal legs of said frame members substantially along the entire length of said form body;

anchoring said form assembly in the ditch; and pouring a moldable trench forming composition around said form assembly anchored in the ditch, whereby said elongate horizontal legs of said frame members cooperate with said form body to counterbalance buoyant forces resulting from said moldable trench forming composition to prevent said form body from shifting upwardly as said trench forming composition sets to form a completed trench.

12. The method of claim 11 wherein said frame members are substantially L-shaped in cross-section.

13. The method of claim 11 wherein said anchoring members extend below said form body.

14. The method of claim 13 wherein said anchoring members comprise foot means at a lower portion thereof.

15. The method of claim 13 wherein said anchoring step comprises positioning a lower portion of said anchoring members in a lower portion of said ditch and forming a subslab around said lower portion of said anchoring members at a location spaced below a bottom surface of said form.

16. The method of claim 14 wherein said anchoring step comprises positioning said foot means in a lower portion of said ditch and forming a subslab around said foot means at a location spaced below a bottom surface of said form body.

17. The method of claim 13 wherein said moldable trench forming composition comprises concrete.

18. The method of claim 17 wherein said removable form comprises a predetermined shape of predetermined dimensions including depth defining a catch basin.

19. The method of claim 11 wherein said horizontal legs of said elongate members comprise rails for supporting a trench grate.

20. The method of claim 19 wherein said removable form body is a foamed plastic body.

21. The method of claim 11 further including the step of removing said form body from said trench following hardening of said trench forming composition.

22. The method of claim 21 further including the step of cutting said form body into a plurality of separate pieces prior to removal of said form body from said trench.

* * * * *

UNITED STATES PATENT AND TRADEMARK OFFICE

CERTIFICATE OF CORRECTION

PATENT NO. : 5,348,421

DATED : September 20, 1994

INVENTOR(S) : Stegall

It is certified that error appears in the above-identified patent and that said Letters Patent is hereby corrected as shown below:

Title page, col. 2,
Please add the following:

Other Publications

Trench Former System, brochure by ABT, Inc., TF 6/92

Neenah Foundry Company Catalog, 1986, pp.262-63; and 1985 (two pages unnumbered)

Trench Former System, brochure by ABT, Inc., TF 6/92

Col. 7, line 33, "prepour" should be --pre-pour--.

Col. 8 lines 46-47, omit the degree marks (°)

Col. 9, line 39, after "nearby" omit the period (.)

Signed and Sealed this

Twenty-seventh Day of August, 1996

*Attest:*

Bruce Lehman

BRUCE LEHMAN

*Attesting Officer*

*Commissioner of Patents and Trademarks*